US005915835A

United States Patent [19]

Fair

[11] Patent Number: 5,915,835

[45] Date of Patent: Jun. 29, 1999

[54] SNOWBLOWER WITH A SIDE DRAFT COMPENSATOR ASSEMBLY

[76] Inventor: Walter Fair, P.O. Box 306, 150 W. Main, Menno, S. Dak. 57045

[21] Appl. No.: 09/141,148

[22] Filed: Aug. 27, 1998

[51] Int. Cl.[6] ..... E01H 5/09

[52] U.S. Cl. ..... 37/241; 37/244

[58] Field of Search ..... 37/260, 248, 244, 37/241, 274, 281, 253, 196

[56] References Cited

U.S. PATENT DOCUMENTS

| | | | |
|---|---|---|---|
| 924,902 | 6/1909 | Harris | 37/260 X |
| 1,552,714 | 9/1925 | Linzy | 37/248 |
| 2,241,252 | 5/1941 | Garland et al. . | |
| 2,387,959 | 10/1945 | Wandscheer | 29/260 X |
| 2,919,504 | 1/1960 | Rubin | 37/244 |
| 2,944,351 | 7/1960 | Kiecker et al. | 37/260 X |
| 3,908,289 | 9/1975 | Ross . | |
| 4,077,139 | 3/1978 | Fagervold et al. . | |
| 4,184,551 | 1/1980 | Orthman . | |
| 4,288,933 | 9/1981 | Fair . | |
| 4,414,903 | 11/1983 | Fasse et al. . | |
| 4,498,253 | 2/1985 | Schmidt | 37/249 |
| 4,616,712 | 10/1986 | Jorgensen | 172/6 |
| 4,930,581 | 6/1990 | Fleischer et al. | 172/6 |
| 4,986,012 | 1/1991 | Majkrzak | 37/248 |
| 5,018,592 | 5/1991 | Buchdrucker | 180/19.3 |
| 5,156,218 | 10/1992 | Schmidt et al. | 172/5 |
| 5,438,770 | 8/1995 | Miller | 37/227 |

FOREIGN PATENT DOCUMENTS

| | | | |
|---|---|---|---|
| 47200 | 11/1929 | Norway | 37/244 |

*Primary Examiner*—Christopher J. Novosad
*Attorney, Agent, or Firm*—Sixbey, Friedman, Leedom & Ferguson; Daniel W. Sixbey

[57] ABSTRACT

The snowblower of the present invention includes a housing and attached to the snowblower is an drive mechanism that actuates a snow gate for movement about a vertical axis, inwardly towards and outwardly away from the snowblower housing. This snow gate engages a snow drift wall to reorient the snowblower with respect to the adjacent snow drift wall thereby preventing the snowblower from veering off the intended path and into an adjacent snow drift.

25 Claims, 2 Drawing Sheets

SNOWBLOWER WITH A SIDE DRAFT COMPENSATOR ASSEMBLY

FIELD OF THE INVENTION

The present invention relates generally to the art of snow blowers and more particularly to large capacity snowblowers having a housing, blade design and hydraulically actuated side draft compensator assembly to facilitate snow removal with enhanced efficiency.

BACKGROUND OF THE INVENTION

Snowblowers have been developed which are propelled by tractors or other vehicles and are operative to remove large quantities of snow from roadways. These snowblowers normally include a self contained power plant to drive rotating snowblower fans which discharge snow through discharge spouts at the top of the blower housing, as shown by U.S. Pat. No. 4,288,933 to Walter Fair. It will be readily appreciated that the components of these large snowblower units must be able to operate effectively in extremely adverse environmental conditions.

It has been a problem in the operation of a large snowblower which is pushed in front or rear of a prime mover to maintain the blower on a straight path, particularly when the snowblower is operating such that only one side of the snowblower is actually encountering a measurable quantity of hard packed snow (e.g., when slicing off a snow bank along the side of a roadway or to widen a previously plowed single lane roadway). In these conditions, the connected snowblower has a tendency to suck into the side bank too far. It becomes impossible to push the blower further, because the blower is out of control and past its volume capacity. The side draft becomes so intense that the prime mover is unable to force the blower head out of the snow without stopping, backing up, and repositioning the unit to take a smaller cut to lessen the cut that the prime mover and blower head can handle.

SUMMARY OF THE INVENTION

The present invention provides a snowblower which includes a side draft compensator assembly with an electro-hydraulic drive mechanism that actuates a reciprocating snow gate about a vertical axis, inwardly toward and outwardly away from a snowblower frame centerline to equalize the draft of the snowblower with respect to an adjacent snow drift wall thereby preventing the snowblower from veering off the intended path and into an adjacent snow drift. The force caused by the gate contacting the adjacent snow wall shifts the frame of the snowblower to a position parallel with the adjacent snow wall. The net effect is to incrementally equalize the draft of the snowblower relative to an adjacent snow wall to prevent the snowblower from unintentionally veering into the snow wall. To equalize the draft so the steering axle of the prime mover can control the blower, the snow gate is adjusted to achieve the maximum degree of compression without unnecessarily damaging the apparatus or obstacles located along the periphery of the cleaned path. The side draft compensator assembly is manually adjustable so that the stroke of the snow gate, (i.e., the distance between the innermost and outermost excursion of the snow gate) can be increased or decreased which in turn, affects the force of the compressions made by the snow gate against an adjacent snow wall. Such adjustments can be made prior to, or during the snow removal process and once set, the adjustments remain fixed until the next adjustment.

Operation of the snow gate also functions to compress the snow drifts and piles adjacent to the snowblower, forming the snow into a reinforced wall, thereby reducing the amount of snow that later cascades back onto the newly cleared path.

It is an object of the present invention to provide a large capacity snowblower which has superior handling so that the snowblower pushes equal so as not to over power the steering axle of the prime mover whereby the time and effort taken to clear a given amount of snow is reduced.

It is a further object of the present invention to provide a snowblower having an apparatus which is capable of reorienting the frame of the snowblower such that it maintains a path that is parallel to the boundary formed between the snowblower and the newly created drift wall.

Another object of the present invention is to provide a snowblower with a draft compensator which uses hydraulic power to shift the blower head out of the hard snow bank enough for the prime mover to again get control of the cutter blower unit without stopping or repositioning. The side draft compensator can be positioned to equalize the side pressure on blower head to prevent the blower head from sucking too deeply into a side bank.

It is still a further object of the present invention to provide a snowblower having an operator-controlled mechanism for selectively operating a snow gate between a first position, in which the snow gate is retracted, and a second position, in which the snow gate is extended thereby reorienting the side draft compensator with respect o an adjacent snow draft wall.

A further object of the present invention is the provision of an apparatus that minimizes the amount of snow and ice that immediately falls back onto a freshly cleared path which may be readily connected to pre-existing snowblowers.

With these and other objects in view, as will be apparent to those skilled in the art, the invention resides in the combination of parts set forth in the specification and covered by the claims appended thereto.

DESCRIPTION OF THE PREFERRED EMBODIMENT

Figure 1:
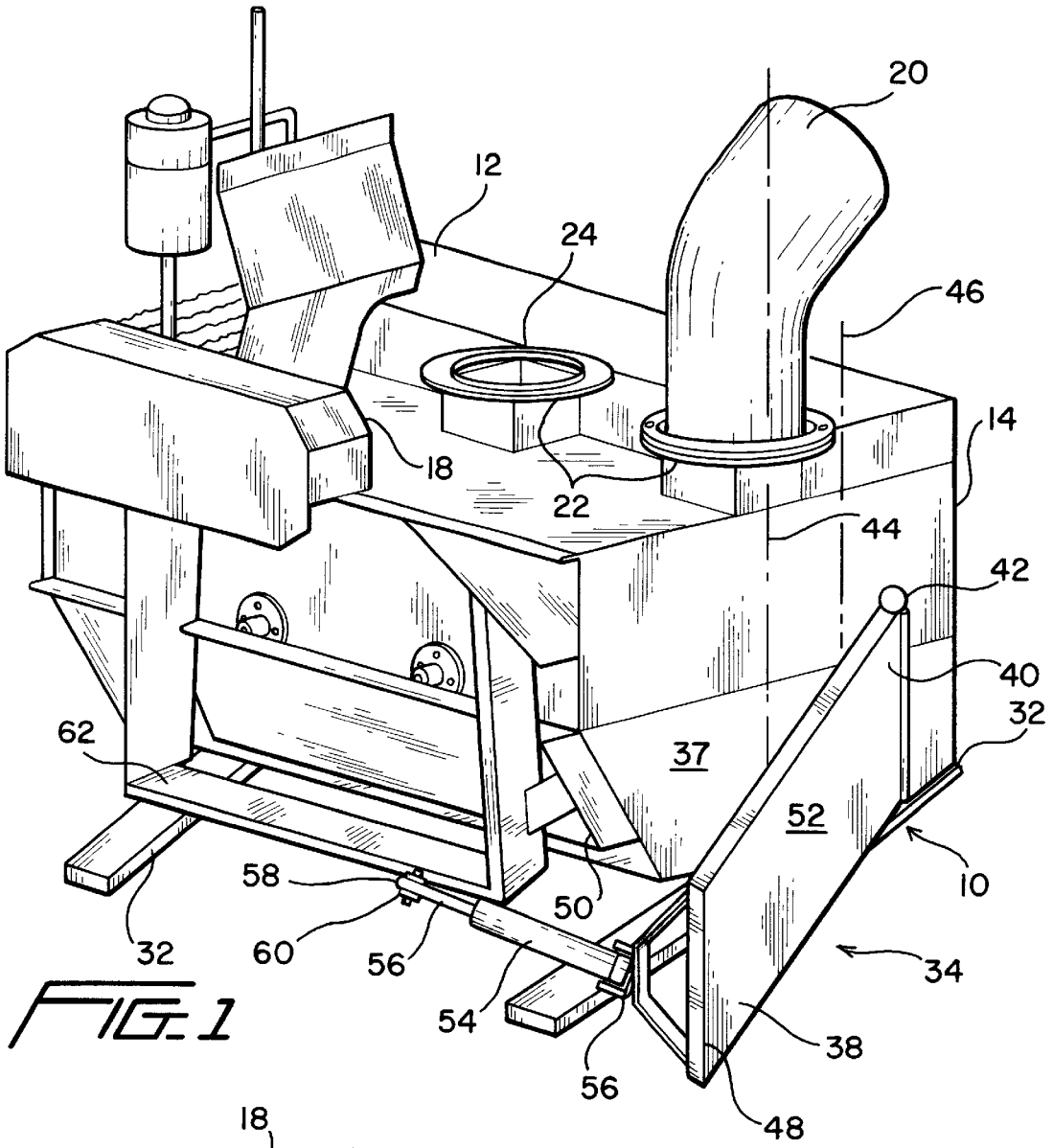
FIG. 1 is a perspective view of the snowblower with a side draft compensator assembly of the present invention.

Referring to the drawings, the snowblower of the present invention indicated generally at 10 includes a housing 12 which is open at the front 14 and which encloses one or more rotatably mounted snowblower blades, each mounted for rotation about its own central shaft. In FIG. 1, the snowblower 10 of the present invention may be similar to that shown by U.S. Pat. No. 4,288,933.

The snowblower blades 14 are driven by a suitable power plant mounted on the housing 12. Each blower blade is associated with a discharge spout 20, one of which is shown in FIG. 1. Each discharge spout is mounted for rotation upon a turntable 22 which is connected with suitable ducting 24 leading to the associated snowblower fan. One snow discharge spout 20 is omitted from FIG. 1 to provide a view of the turntable 22 and ducting 24.

The snowblower 10 is propelled by a tractor or similar vehicle 18 which is attached to the snowblower by means of suitable brackets 26. Once coupled to a tractor or similar prime mover, the brackets allow an operator to raise the snowblower for easy transportation of the device when it is not in use, and to lower the snowblower in order to perform snow removal operations. The brackets also permit the snowblower to freely sway from left to right thereby allowing an operator of a adjoining prime mover to maneuver the snowblower by simply altering the lateral orientation of the prime mover with respect to the snowblower, so as to allow the prime mover steering axle to take control. For example, to maneuver the snowblower to the right, the operator would steer the prime mover steering axle to the left; to maneuver the snowblower to the left the operator would steer the prime mover to the right and to maintain the snowblower on a straight path, the operator would steer the prime mover to a central point behind the snowblower and maintain that position. To facilitate movement of the snowblower on a surface of snow or ice, the snowblower is provided with skids or runners 32.

Figure 2:
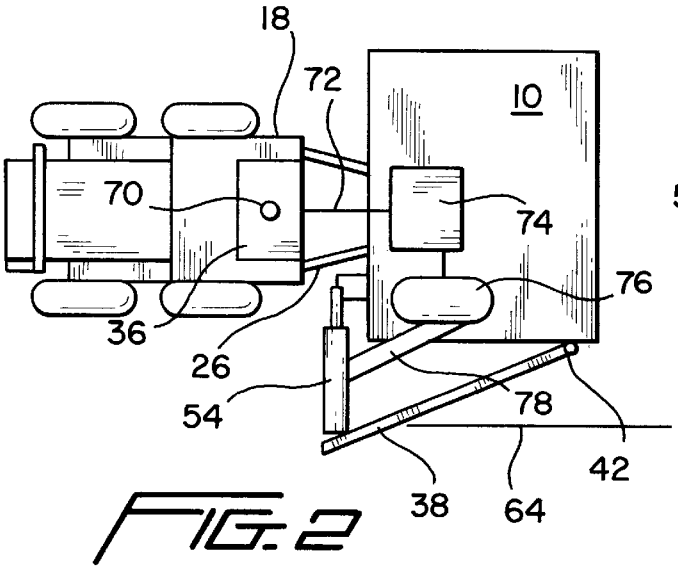
FIG. 2 is a diagrammatic illustration of the snowblower with a side draft compensator assembly connected to a prime mover.
Figure 3:
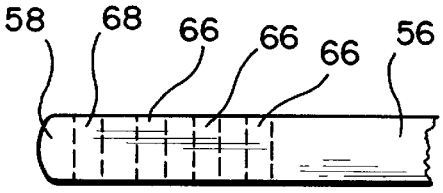
FIG. 3 is a view in side elevation of a section of a drive piston for use with the invention of FIG. 1.

The snowblower 10 is provided with a side draft compensator assembly indicated at 34 which is controlled by a control unit 36 at the operator station on the tractor 18. Although only one compensator assembly is shown attached to the right side 37 of the snowblower 10 in FIGS. 1 and 2, there may be instances where the compensator assembly is provided on the left side of the snowblower or compensator assemblies could be provided on both sides of the snowblower.

The side draft compensator assembly 34 includes an elongated snow gate 38 which is pivotally attached at a forward end 40 to the snowblower by a supporting hinge unit 42. It is important for the forward end of the snow gate to be secured to the snowblower close to the front end 14. The attaching hinge unit 42 must always be located forward of the lateral midpoint 44 of the snowblower so that when the snow gate 38 is extended against a snow bank, the force applied to the snowblower will tend to move the front end away from the snow bank. Thus it is advantageous for the forward end 40 of the snow gate to be pivotally attached to the snowblower at a point forward of the halfway point 46 between the lateral midpoint 44 and the front 14 of the snowblower.

The snow gate 38 is a reinforced, substantially rectangular blade which extends rearwardly from the hinge unit 42 to a rear end 48 which is spaced outwardly beyond the rear end 50 of the housing 12. The snow gate includes a flat outer surface 52 which will engage and slide relative to a snow bank as the snowblower moves forward.

A hydraulic cylinder 54 is pivotally attached by a bracket 56 to the rear end 48. Extending from the hydraulic cylinder is a piston 56 having an outer end 58 which is pivotally attached to a bracket 60 secured to a frame 62 formed on the rear side of the snowblower 10. The hydraulic cylinder and piston are dimensioned such that when the piston is fully retracted within the hydraulic cylinder, the snow gate 38 will lie against the side 37 of the housing 12 and extend substantially parallel thereto. As the piston is extended, the snow gate pivots outwardly about the hinge unit 42 at an angle to the side 37 of the housing 12. Since the snow gate requires an extensive surface 52 to engage a snow bank to develop the force necessary to offset forces on the forward end of the snowblower, it is important that the maximum angle of the snow gate relative to the housing 12 be such as not to impede continued forward movement of the snowblower. Obviously, if the snow gate is allowed to pivot out to an angle approaching ninety degrees, it will dig into a snow bank and operate as a brake. Also if the angle of the snow gate becomes too great, the front end of the snowblower may be forced too far outwardly from the snow bank resulting in an overcompensation. The maximum angle of extension of the snow gate 38 relative to the housing 12 will be forty five degrees.

The control unit 36 includes a three position (extend, retract, open) switch 70 that makes or breaks a circuit 72 between the tractor battery and a hydraulic controller 74 on the snowblower. The hydraulic controller can be an electrically driven pump such that when the switch 70 is actuated in the extend position, the hydraulic controller 74 pumps hydraulic fluid from a tank 76 over a line 78 to the hydraulic cylinder 54 to extend the piston 56. When the switch 70 is actuated in the retract position, the hydraulic controller 74 extracts fluid from the hydraulic cylinder 54 back into the tank 74 to retract the piston 56. When the switch 70 is actuated in the open position, it breaks the circuit between the tractor battery and the hydraulic controller 74 halting the flow of hydraulic fluid from the tank 76 and the hydraulic cylinder such that the piston maintains its current position.

The angle of the snow gate 38 relative to the housing 12 may be altered by adjusting the extension length of the piston 56. In other words, when the operator wishes to extend the gate, the operator positions the switch 70 in the extend position. Once the piston has been extended to the desired position, the operator then positions the switch to the open position to halt further movement by the snow gate 38. When the operator wishes to retract the snow gate 38, the operator positions the switch 70 in the retract position. As previously stated, when the operator wishes to halt further movement of the snow gate 38, the operator positions the switch in the open position.

Figure 4:
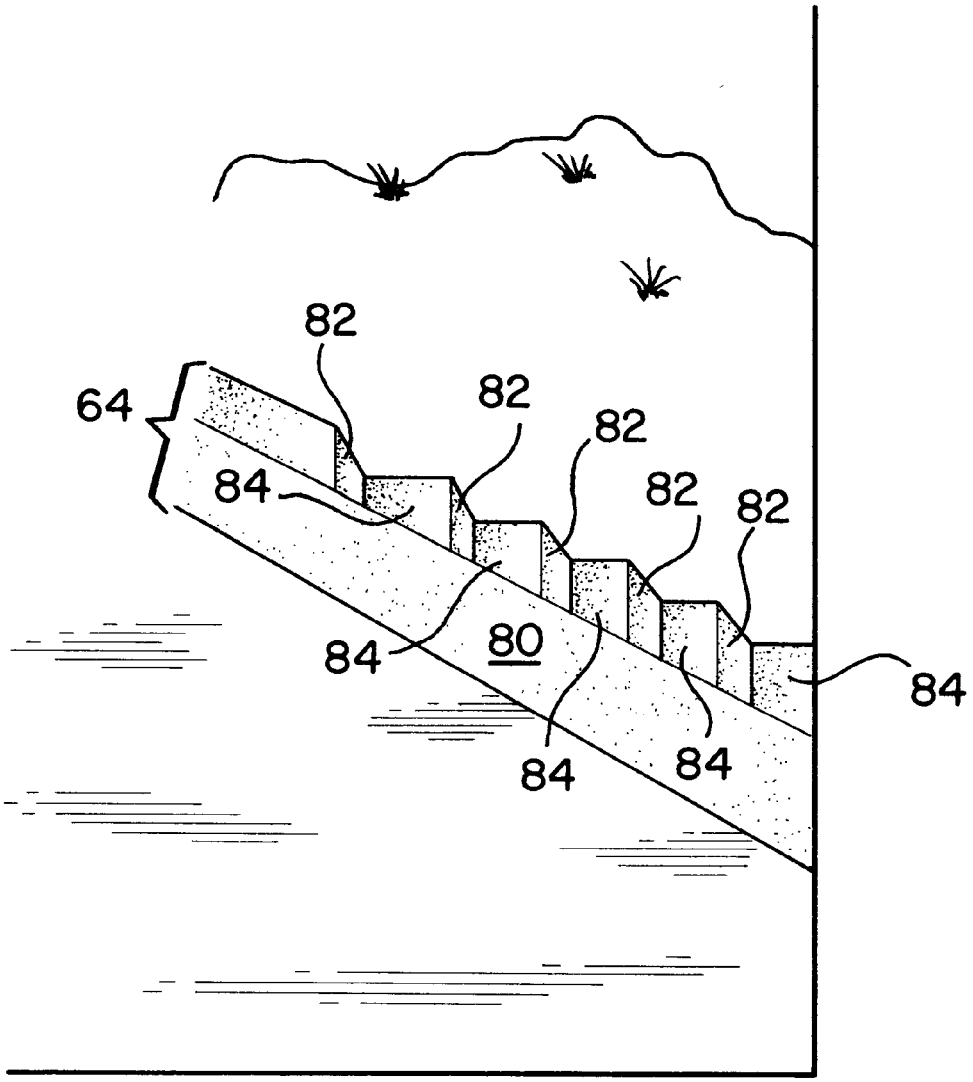
FIG. 4 is a perspective view of a newly cleared path and the contour formed on an adjacent snow wall by the side draft compensator.

Thus, in operation, when the operator of the snowblower 10 wishes to adjust the draft of the snowblower in relation to an adjacent snow wall 64, the operator actuates the controller 70 which causes the piston 56 to extend outward. As the snowblower travels forward, cutting a snow bank, lateral pressure builds up forcing the snowblower housing into the snow bank which in turn causes the housing to form ridges 82 in the upper portion of the snow bank as shown in FIG. 4. As the housing drifts farther into the snow bank, pressure builds up between the outer surface 52 of the side draft compensator and the lower portion of the snow drift, compressing the snow along the lower portion of the snow drift and forming the smooth lower surface 80 shown in FIG. 4. The pressure between the side drift compensator and the adjacent snow wall continues to build until enough force is created to thrust the snowblower housing a lateral distance 84 out of the adjacent snow bank. The sudden movement of the snowblower housing places the snowblower back onto the desired path and causes the snow to suddenly fracture in front of the blower head. The more dense the snow contained in an adjacent snow wall, the more effective the side draft compensator assembly will be at correcting the path of the snowblower. As the snowblower proceeds along a given path, an operator may find it necessary to extend/retract the side draft compensator assembly to compensate for the change in snow density and to maintain the snowblower on a desired path. In other words, the greater the angular displacement of the snow gate from the snowblower housing, the greater the lateral displacement of the snowblower from an adjacent snow bank after actuation of the side draft control attachment. The process of adjusting the snow draft compensator apparatus can be repeated as many times as deemed necessary by the operator to maintain the equilibrium of the snowblower and thus keep the snowblower head from over powering the steering axle of the prime mover.

It should also be noted that the snowblower housing 12 forges a snow wall with the adjacent snow bank as the snowblower advances to clear a path. In prior art snowblowers, portions of this newly-created snow wall tended to cascade back onto the recently cleared path after the snowblower housing had advanced beyond a point where it could provide a means of support for the snow wall. With the present invention however, the process of actuating the draft compensator apparatus causes a force to be placed on an adjacent snow drift by the extended snow gate which has the dual effect of maintaining the equilibrium of the snowblower head and also packing and stabilizing the snow as shown at 80 into the snow drift wall. The packed snow acts to reinforce the recently created snow wall thereby preventing it from cascading back onto the newly cleared path.

I claim:

1. A snowblower comprising:

a snowblower housing for enclosing snowblower blades, said housing having spaced sidewalls having front ends defining a housing front end and a housing rear wall extending between said sidewalls in spaced relation to said housing front end, said housing having a lateral midpoint between said housing front end and housing rear wall, an elongate snow gate having a first end pivotally attached to a housing sidewall at a point closer to said housing front end than a point halfway between said lateral midpoint and housing front end, said snow gate extending toward said housing rear wall from said first end to a second end, and a drive unit connected to said snow gate adjacent to the second end thereof and to said snowblower housing, said drive unit operating to pivot said snow gate at said first end to move said second end both toward and outwardly away from said snowblower housing.

2. The snowblower of claim 1 wherein said elongate snow gate includes a flat outer surface extending between the first and second ends thereof.

3. The snowblower of claim 1 wherein skids are attached to extend beneath said housing, said elongate snow gate extending from said first end along said sidewall to the second end which is spaced outwardly beyond said housing rear wall.

4. The snowblower of claim 1 wherein said drive unit is adjustable to adjust the distance that said snow gate second end can move outwardly away from said snowblower housing to vary the angle between said snow gate and said snowblower housing.

5. The snowblower of claim 1 wherein said drive unit is formed to limit the maximum distance that said snow gate second end can move outwardly away from said snowblower housing to a maximum distance that will form a maximum angle of forty five degrees between said snow gate and said snowblower housing.

6. The snowblower of claim 5 wherein said drive unit is adjustable to adjust the distance that said snow gate second end can move outwardly away from said snowblower housing to vary the angle between said snow gate and said snowblower housing.

7. The snowblower of claim 6 wherein said first end of said snow gate is pivotally attached to said housing sidewall at a point closer to said housing front end than a point halfway between said lateral midpoint and housing front end.

8. The snowblower of claim 7 wherein said elongate snow gate includes a flat outer surface extending between the first and second ends thereof.

9. The snowblower of claim 8 wherein skids are attached to extend beneath said housing, said elongate snow gate extending from said first end along said sidewall to the second end which is spaced outwardly beyond said housing rear wall.

10. The snowblower of claim 9 wherein said drive unit includes a cylinder and piston connected between said snow gate and said housing.

11. A side draft compensator assembly for a snowblower having a snowblower housing enclosing snowblower blades with spaced housing sidewalls having front ends defining an open front end for said housing and a housing rear wall, said side draft compensator assembly comprising an elongate snow gate having a forward end and a rear end for pivotal attachment to said snowblower for pivotal movement relative to a housing sidewall, said elongate snow gate to be pivotally attached adjacent to the front end of said sidewall at a point closer to said housing front end than a point halfway between a lateral midpoint of said sidewall and said housing front end and extending from said pivotal attachment rearwardly toward said housing rearward to said snow gate rear end, a drive unit for connection between said elongate snow gate and said snowblower, said drive unit being connected adjacent to the snow gate rear end and operating to pivot said snow gate about said pivotal attachment to move said snow gate rear end toward and away from said sidewall, and a drive unit control assembly to activate said drive unit.

12. The side draft compensator assembly of claim 11 wherein said elongate snow gate includes a flat outer surface extending between the forward and rear ends thereof.

13. The side draft compensator assembly of claim 12 wherein said drive unit includes a cylinder and piston.

14. A snowblower comprising:

a snowblower housing for enclosing snowblower blades, said housing having spaced sidewalls having front ends defining a housing front end and a housing rear wall extending between said sidewalls in spaced relation to said housing front end, said housing having a lateral midpoint between said housing front end and housing rear wall, an elongate snow gate having a first end pivotally attached to a housing sidewall between said lateral midpoint and said housing front end, said snow gate extending toward said housing rear wall from said first end to a second end, wherein said elongate snow gate includes a flat vertical outer surface extending between said first and second ends, and a drive unit connected to said snow gate adjacent to the second end thereof and to said snowblower housing, said drive unit operating to pivot said snow gate at said first end to move said second end both toward and outwardly away from said snowblower housing.

15. The snowblower of claim 14 wherein said first end of said snow gate is pivotally attached to said housing sidewall at a point closer to said housing front end than a point halfway between said lateral midpoint and housing front end.

16. The snowblower of claim 15 wherein skids are attached to extend beneath said housing, said elongate snow gate extending from said first end along said sidewall to the second end which is spaced outwardly beyond said housing rear wall.

17. The snowblower of claim 14 wherein said drive unit is adjustable to adjust the distance that said snow gate second end can move outwardly away from said snowblower housing to vary the angle between said snow gate and said snowblower housing.

18. The snowblower of claim 14 wherein said drive unit is formed to limit the maximum distance that said snow gate second end can move outwardly away from said snowblower housing to a maximum distance that will form a maximum angle of forty five degrees between said snow gate and said snowblower housing.

19. The snowblower of claim 18 wherein said drive unit is adjustable to adjust the distance that said snow gate second end can move outwardly away from said snowblower housing to vary the angle between said snow gate and said snowblower housing.

20. The snowblower of claim 19 wherein said first end of said snow gate is pivotally attached to said housing sidewall at a point closer to said housing front end than a point halfway between said lateral midpoint and housing front end.

21. The snowblower of claim 20 wherein said elongate snow gate includes a flat outer surface extending between the first and second ends thereof.

22. The snowblower of claim 21 wherein skids are attached to extend beneath said housing, said elongate snow gate extending from said first end along said sidewall to the second end which is spaced outwardly beyond said housing rear wall.

23. The snowblower of claim 22 wherein said drive unit includes a cylinder and piston connected between said snow gate and said housing.

24. A side draft compensator assembly for a snowblower having a snowblower housing enclosing snowblower blades with spaced housing sidewalls having front ends defining an open front end for said housing and a housing rear wall, said side draft compensator assembly comprising an elongate snow gate having a forward end and a rear end for pivotal attachment to said snowblower for pivotal movement relative to a housing sidewall, wherein said elongate snow gate includes a flat vertical outer surface extending between said forward and rear ends, said elongate snow gate to be pivotally attached adjacent to the front end of said sidewall at a point closer to said housing front end than a point halfway between a lateral midpoint of said sidewall and said housing front end and extending from said pivotal attachment rearwardly toward said housing rearward to said snow gate rear end, a drive unit for connection between said elongate snow gate and said snowblower, said drive unit being connected adjacent to the snow gate rear end and operating to pivot said snow gate about said pivotal attachment to move said snow gate rear end toward and away from said sidewall, and a drive unit control assembly to activate said drive unit.

25. The side draft compensator assembly of claim 24 wherein said drive unit includes a cylinder and piston.

* * * * *